United States Patent [19]

Rosenberg et al.

[11] 4,256,262

[45] Mar. 17, 1981

[54] MOUNTING FOR WATER IRRIGATION DEVICE

[76] Inventors: Peretz Rosenberg; Avner Rosenberg, both of Moshav Beit Shearim, Israel

[21] Appl. No.: 88,072

[22] Filed: Oct. 24, 1979

[51] Int. Cl.[3] ..... A62C 31/22

[52] U.S. Cl. ..... 239/276; 239/587; 248/88

[58] Field of Search ..... 239/276, 280, 280.5, 239/587, 588; 248/82, 84, 86, 88

[56] References Cited

U.S. PATENT DOCUMENTS

| | | | |
|---|---|---|---|
| 2,711,927 | 6/1955 | Miller | 239/588 X |
| 3,941,342 | 3/1976 | Bradshaw | 239/276 X |

*Primary Examiner*—Richard A. Schacher

*Attorney, Agent, or Firm*—Benjamin J. Barish

[57] ABSTRACT

A mounting for a water irrigation device comprises a vertical post secured at one end to a ground stake and carrying at its opposite end a cylindrical horizontal socket for frictionally receiving the stem of a fitting adapted to mount the water irrigation device, the latter device being connected to a water supply conduit by a flexible tube having connectors at its opposite ends attachable to the water supply pipe and to the fitting.

9 Claims, 3 Drawing Figures

MOUNTING FOR WATER IRRIGATION DEVICE

BACKGROUND OF THE INVENTION

The present invention relates to a mounting for a water irrigation device, such as a water sprinkler or sprayer.

Mountings for water irrigation devices commonly include a ground stake adapted to be inserted into the ground for supporting the water irrigation device, and a flexible tube connectable to a water supply pipe for supplying water to the water irrigation device. An example of known arrangement is described in U.S. Pat. No. 3,751,075. The known mounting arrangements, however, generally do not permit the inclinaton of the irrigation device to be conveniently adjusted according to the requirements at the specific location of use; moreover, they usually require the ground stake to be inserted perfectly vertically into the ground if uniform horizontal sparying is desired.

BRIEF SUMMARY OF THE INVENTION

An object of the present invention is to provide a novel type of mounting for a water irrigation device which not only has advantages in the above respects, but which is also constituted of a few simple parts that can be readily produced at low cost and permit the water irrigation device to be mounted in a simple and convenient manner.

According to the present invention, there is provided a mounting for a water irrigation device, comprising a ground stake adapted to be inserted into the ground, and a vertical post carried at one end of the ground stake to extend in a vertical direction. A cylindrical horizontal socket is carried at the opposite end of the vertical post and has a longitudinal axis disposed at right angles to the longitudinal axis of the post so as to extend in the horizontal direction at the upper end of the vertical post when the ground stake is inserted into the ground. The mounting further includes a fitting having a laterally-extending cylindrical stem frictionally receivable in the socket to permit manual rotation of the fitting about the longitudinal axis of the socket. A cavity is formed in the upper end of the fitting for receiving the water irrigation device. Further included is a flexible tube having a first connector at one end for attachment to a water supply pipe, and a second connector at the opposite end for attachment to the fitting to supply water to the water irrigation device when received in the cavity at the upper end of the fitting.

In the preferred embodiment of the invention described below, the cavity formed at the upper end of the fitting is of a configuration for frictionally receiving a water irrigation device having a conical configuration. In addition, the fitting is formed at its lower end with a second cavity of a configuration for frictionally receiving a conical connector on the respective end of the flexible tube. Preferably, both of the cavities formed in the upper and lower ends of the fitting are constituted of a cylindrical bore formed axially through the fitting.

Such a mounting can not only be inexpensively produced and conveniently used, but also permits the water irrigation device to be conveniently adjusted to any inclination according to the requirements at the speific location of use.

Futher features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
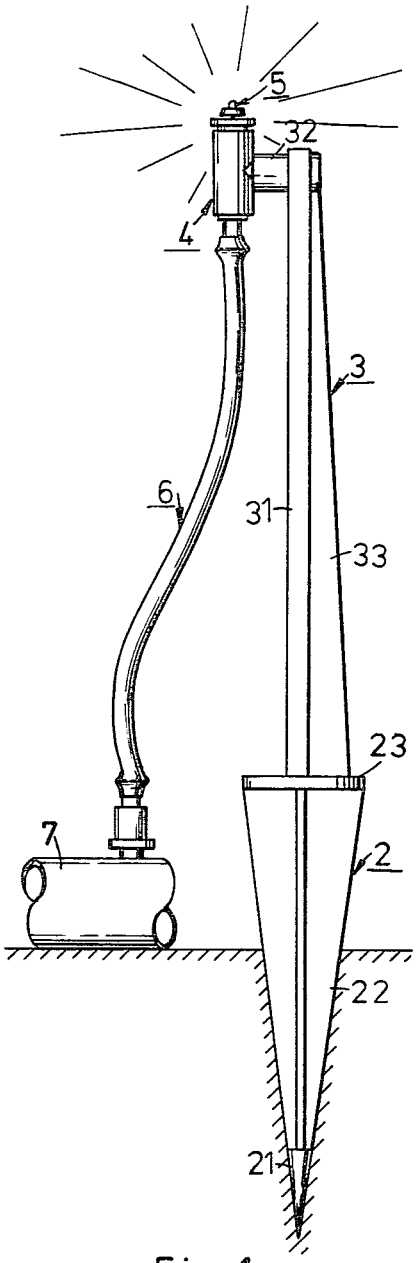
FIG. 1 is a side elevational view illustrating one form of water sprinkler mounting constructed in accordance with the invention.

The water sprinkler mounting illustrated in the drawings comprises a ground stake, generally designated 2, adapted to be inserted into the ground to thereby support a vertical post 3 which in turn is adapted to support, at its upper end, a fitting 4 receiving the water sprinkler 5. A flexible tube 6 is connected at one end to a water supply pipe 7 resting on the ground, and at its opposite end to the fitting 4 for supplying water to the sprinkler 5.

More particularly, the ground stake 2 includes a solid, pointed, conical end 21 for insertion into the ground and joined. to four tapered ribs 22 disposed at right angles to each other and of increasing width in the vertical direction. The upper ends of the ribs 22 are in turn joined to a circular disc 23 of the same diameter as the rib upper ends.

Figure 2:
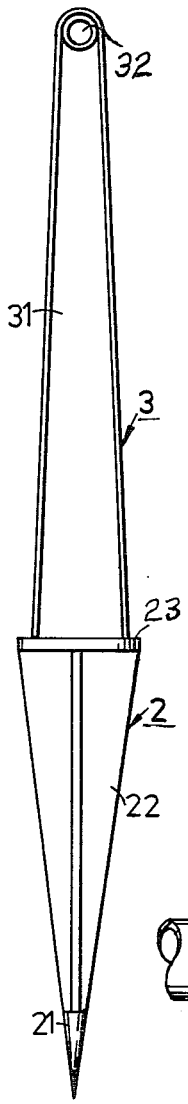
FIG. 2 is an end elevational view of the mounting of FIG. 1.

Vertical post 3 includes a flat rigid strip 31 joined at its lower end to circular disc 23 and carrying, at its upper end, a cylindrical socket 32. Socket 32 has a longitudinal axis at right angles to the longitudinal axis of the post 3 so as to extend in the horizontal direction when the ground stake 2 is inserted vertically into the ground, as shown in FIG. 1. Post 3 further includes a flat rib 33 joined at right angles to strip 31 along its longitudinal axis. As can be clearly seen from FIGS. 1 and 2, strip 31 and rib 33 are both of decreasing width from their lower ends joined to disc 23 of the ground stake 2, to their upper ends joined to the socket 32.

Figure 3:
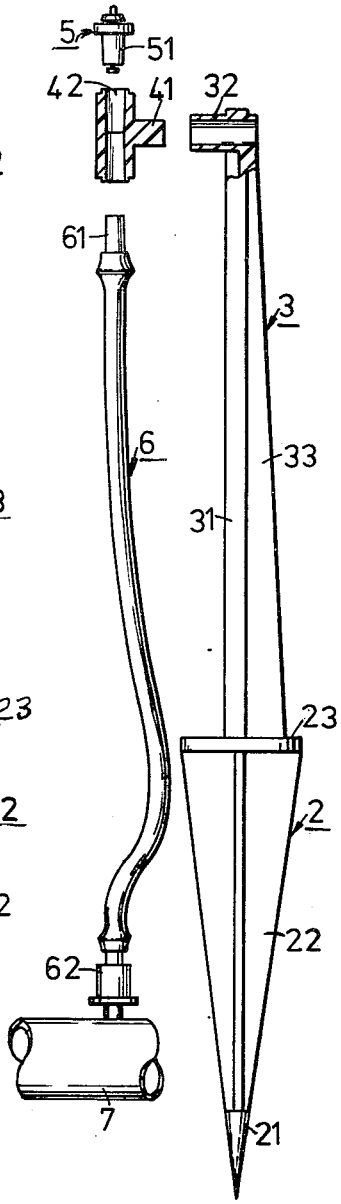
FIG. 3 is an exploded side elevational view of the mounting of FIG. 1.

Fitting 4 is of cylindrical shape and is formed with a laterally-extending stem 41 (FIG. 3), which stem is frictionally receivable within socket 32 of post 3. Fitting 4 is further formed with a cylindrical bore 42 (FIG. 3) extending axially therethrough.

The upper end of bore 42 is adapted to receive the water sprinkler 5. For this purpose, the sprinkler is formed with a depending base 51 of conical configuration for providing a frictional fit when received in the upper end of bore 42. As one example, the water sprinkler 5 may be of the spray nozzle type illustrated in U.S. Pat. No. 3,958,760.

The lower end of the axial bore 42 formed through fitting 4 serves as a second cavity for receiving a conical connector 61 carried at the upper end of the flexible tube 6. The lower end of the flexible tube carries a second connector 62 which is inserted through the wall of the water supply pipe 7. The connectors 61 and 62 may be of the type illustrated in the above-cited U.S. Pat. No. 3,751,075.

Preferably, the ground stake 2 and the vertical post 3 including the horizontal socket 32 carried at the upper end of the latter, are formed as an integral unit from plastics material. If desired, the flat outer face of the vertically-extending strip 31 may be used for the firm name, advertising purposes or like.

It will thus be seen that a simple and inexpensive mounting is provided which can be produced in volume and at low cost and which can be applied in a convenient manner to mount a water sprinkler 5, where desired, and to tap same to a water supply pipe. As indicated earlier, a particularly important advantage in the illustrated mounting is that the inclination of the water sprinkler 5 may be set to any desired angle by merely manually gripping the fitting 4 and rotating its stem 41 within the horizontal socket 32, the frictional fit between the stem and socket being sufficient to retain the fitting and the water sprinkler at the preset angular position. Thus, the sprinkler 5 may be conveniently set to a horizontal position to provide horizontal spraying, or to any desired angular position.

While the invention has been described with respect to one peferred embodiment, it will be appreciated that many other variations, modifications, and applications of the invention can be made.

What is claimed is:

1. A mounting for a water irrigation device, comprising: a ground stake adapted to be inserted into the ground; a vertical post carried at one end said ground stake to extend in a vertical direction when the ground stake is inseted into the ground; a cylindrical horizontal socket carried at the opposite end of said vertical post and having a longitudinal axis disposed at right angles to the longitudinal axis of the post so as to extend in the horizontal direction at the upper end of the vertical post when the ground stake is inserted into the ground; a fitting having a laterally-extending cylindrical stem frictionally receivable in said socket and permitting manual rotation of the fitting about said longitudinal axis of the socket; a cavity formed in the upper end of said fitting for receiving the water irrigation device; and a flexible tube having a first connector at one end for attachment to a water supply pipe, and a second connector at the opposite end for attachment to the fitting to supply water to the water irrigation device when received in the said cavity.

2. The mounting according to claim 1, wherein said cavity formed at the upper end of the fitting is of a configuration for frictionally receiving the water irrigation device having a conical configuration.

3. The mounting according to claim 2, wherein said second connector of the flexible tube is also of conical configuration, and said fitting is also formed at its lower end with a second cavity of a configuration for frictionally receiving same.

4. The mounting according to claim 3, wherein said cavities formed in the upper and lower ends of said fitting are constituted of a cylindrical bore formed axially through said fitting.

5. The mounting according to claim 4, wherein said fitting is of cylindrical configuration and is integrally formed at a mid-portion thereof with said laterally-extending cylindrical stem.

6. The mounting according to claim 1, wherein said horizontal socket and vertical post are integrally formed as a single unit with said ground stake.

7. The mounting according to claim 1, wherein said ground stake includes a solid, pointed, conical end for insertion into the ground, joined to four tapered ribs disposed at right angles to each other and of increasing width in the direction away from said pointed end.

8. The mounting according to claim 7, wherein the ground stake further includes a circular disc joined to, and of the same diameter as, the ends of the four tapered ribs opposite to said pointed end.

9. The mounting according to claim 1, wherein said vertical post includes a flat strip joined at its opposite ends to the ground stake and to the horizontal socket, respectively, and a flat rib joined at right angles to said flat strip along its longitudinal axis, said flat strip and rib being of decreasing width from the ground stake to the horizontal socket, respectively.

* * * * *